United States Patent [19]

Stoffey

[11] 3,955,566

[45] May 11, 1976

[54] SYSTEM AND METHOD FOR RIGID ENCLOSURES

[76] Inventor: Donald G. Stoffey, P.O. Box 1610, Salinas, Calif. 93901

[22] Filed: Jan. 19, 1973

[21] Appl. No.: 323,421

Related U.S. Application Data

[63] Continuation-in-part of Ser. No. 318,201, Jan. 8, 1973, abandoned, which is a continuation-in-part of Ser. No. 224,220, Feb. 7, 1972, abandoned.

[52] U.S. Cl. ..... 128/90; 424/28; 156/184; 264/222; 427/299; 427/412

[51] Int. Cl.[2] ..... A61F 5/04

[58] Field of Search ..... 128/90; 424/28; 156/184; 264/222; 117/47 R, 62.2, 76 T, 161 VC, 161 VB, 161 VZ

[56] References Cited

UNITED STATES PATENTS

| | | | |
|---|---|---|---|
| 2,576,027 | 11/1951 | Means | 128/90 |
| 3,027,336 | 3/1962 | Gotz et al. | 128/90 X |
| 3,089,486 | 5/1963 | Pike | 128/90 |
| 3,148,669 | 9/1964 | Witcher | 128/90 X |
| 3,630,114 | 12/1971 | Boardman | 128/90 |

OTHER PUBLICATIONS

Chem. Abstract CA 51: 18685*i* Brauer.

*Primary Examiner*—Robert W. Michell
*Assistant Examiner*—Vincent Millin
*Attorney, Agent, or Firm*—Harry A. Pacini

[57] ABSTRACT

An improved system and method for producing lightweight and strong rigid enclosures formed by enclosing or wrapping the article in a dry peroxide catalyst-impregnated fabric and applying thereto an activated thermosetting vinyl type resin. The disclosed enclosure is especially useful as a porous surgical dressing or as an orthopedic support.

17 Claims, No Drawings

SYSTEM AND METHOD FOR RIGID ENCLOSURES

This application is a continuation-in-part application of application Ser. No. 318,201, filed Jan. 8, 1973, now abandoned, which in turn is a continuation-in-part of application Ser. No. 224,220, filed Feb. 7, 1972, now abandoned.

This invention relates to an improved system and method for preparing enclosed bodies, moldings and casts.

BACKGROUND OF THE INVENTION

Several attempts have been made to adopt modern plastic technology to the production of rigid enclosures for such segments as a living body, human or animal. The use of rigid body and body member casts are important to assist in the healing of tissues and in knitting of fractures of the bone.

Such methods have incorporated systems, which have been disadvantageous for one of many reasons. For example, one method is dependent upon a closed plastic bag which is wrapped around the member and a plastic foam is allowed to develope in the bag. This system of encasement is slow, difficult to apply and very hot and uncomfortable for the wearer. The system does not allow air to enter or leave the appliance.

The conventional plaster of Paris systems have many dissatisfactory properties. Particularly, the casts formed therewith are heavy, X-ray impervious, absorb excessive moisture which thereby destroys the mechanical property, soil rapidly, are difficult to clean, poor shock resistance, lack elasticity, slow to reach ultimate strength, poor abrasive resistance and receptive to bacterial and fungal growth.

It also has been proposed to soften sheets of plastic materials and apply them to the part of the body to be immobilized so as to set upon cooling to a desired position. Unfortunately, the temperature to which such thermoplastic materials must be raised to make them moldable is too high to be endured by a patient unless an insulating intermediate material is first applied.

Certain systems and methods of casting have been proposed which utilize polymerizing systems and polymerizing bandages. However, these systems employ large amounts of liquid volatile and non-volatile diluents to replace part of the monomer as liquid extenders or wetting material. The presence of such volatile liquids are unsatisfactory. The presence of non-volatile viscous diluents do not cause vapor cells and form weak casts due to inadequate wetting of the solid filter or inability to satisfactorily dissolve the polymer formed and the like. Various catalyzed and accelerated mixtures of monomeric solvents within the prior diluent systems attempt to overcome the disadvantages thereof by addition of non-polymerizable polyalcohol esters. The problem of noxious volatile fumes remains. This is highly undesirable when such a system is used in a confined area. Further, the method for body use requires the coating of the body member with petrolatum or other protectant, this prevents air from reaching the injured member.

The prior art, U.S. Pat. No. 3,089,486, discloses a methacrylate polymer impregnant which is imbued into a bandage. The bandage in this form can be stored, however, this requires constant monitoring to insure a usable material. Further, the system described therein requires applying a barrier to the body member prior to applying the monomer component. This presents the disadvantage of placing an air impervious barrier which allows moisture to collect under the barrier from body prespiration, thereby inducing skin irritation.

Means, in U.S. Pat. No. 2,576,027, describes impregnating a cloth such as surgical gauze or the like, with a chemical that acts as a catalyst with reference to a solution of a synthetic resin. The solution of synthetic resin is applied to the gauze to form a rigid solid. The catalyst and synthetic resin relates to a specific urea-formaldehyde system. The catalyst system described by Means is not effective in curing vinyl-type monomers and cannot be used with the instant invention.

The prior art, U.S. Pat. Nos. 3,421,501 and 3,613,675, describe bandages which contain an activated resin. The bandages are cured by exposure to ultraviolet light.

SUMMARY OF THE INVENTION

The present invention possesses definite advantages over the above-described systems. Primarily, it requires neither a pail of plaster of Paris, nor the soaking of a prepared plaster gauze material. Further, there is no need for actinic radiation to catalyze the system into a rigid form. The requirement of ultraviolet irradiation includes the distinct advantage that such a system must be necessarily employed near a source of electrical power. Further, such systems produce a slower cured resin enclosure. It is inherently difficult to irradiate certain areas such as in a cast utility, as under the arm or crotch. Further advantages of the present invention are fast curing and the presence of no volatile solvents. The cured system is light in weight and possesses an open configuration which allows good air exchange with the underlying member. The physical properties of the system are not greatly affected by exposure to water allowing for the possibility of washing the encased or immobilized member.

The present invention relates to a fully usable system which functions without further reference to any other system. It is understood that to be usable, a catalyzed fabric and a resin must be used in combination. Therefore, the improved operable system of this invention relates to the use of wrapping material treated and impregnated with a free radical catalyst, such as organic peroxides, then applying by a suitable means a resin containing active unsaturated radicals, as found in polyesters and acrylics, and containing tertiary aromatic amine accelerator.

The instant invention is contemplated for resin structures and enclosures for a wide variety of uses, e.g., models, toys, linings, shaped articles generally. Porous surgical dressings, orthopedic supports, and like objects, can be readily prepared. Further, for easily prepared plastic shells the present system is easily applicable as well as for repairs and maintenance of such items, ie.g, fiber glass bodies on cars and boats. Without the requirement of heat or special preparation, the instant system is especially useful.

Accordingly, it is a principal object of this invention to provide for the application of orthopedic casts of body members or enclosures of other articles which comprises enclosing said member in an organic peroxide catalyst impregnated, woven or non-woven fabric and applying to said enclosed member a thermosetting polyester or thermosetting acrylic monomer of the dimethacrylate type, containing a tertiary aromatic amine accelerator to form a hard, lightweight, rigid physiologically inert integral enclosure or case.

A further object of this invention is to provide for the application of orthopedic casts or enclosures for articles formed of lightweight plastic wherein the hardening or setting of the plastic is accomplished by an organic peroxide catalyst impregnated in the enclosing fabric.

DETAILED DESCRIPTION OF THE INVENTION

As a general definition, the group of resins include the members defined as thermosetting polyesters and thermosetting acrylics, also known as vinyl resins, those members having active terminal ethylene unsaturation or poly functional unsaturated ester moieties. Representative of this group is the following list:

ethylene glycol dimethacrylate
diethylene glycol dimethacrylate
triethylene glycol dimethacrylate
hexamethylene glycol dimethacrylate
2,2-bis(2-methacrylatoethoxyphenyl)propane
2,2-bis(3-methacrylato-2-hydroxypropoxyphenyl)-propane
phthalic-maleic-propylene glycol polyester Resin blends comprising two or more thermosetting acrylic monomers are also contemplated. Resin blends comprising at least one thermosetting acrylic monomer and one or more thermosetting polyester resins are within the resins defined herein. In some instances, these blends constitute a preferred resin composition for the method of the instant invention, in that they produce the least amount of heat during the curing (i.e., polymerization) of the resin. The cast material can contain a blend of resins of up to about 90 percent, preferably about 65 to 75 percent, of acrylic resin and from about 5 to 35 percent polyester resin, preferably about 25 to 35 percent. These percentages are based upon the total weight of the blended resin.

The monomer or resin-forming component is preferably advanced to an activated state. The activation develops in the resin when the system is combined with an accelerator and in which condition the activated monomer thus prepared retains a reasonable shelf-life. In order to arrive at this activated state in the resin, it is preferred to employ, as an accelerator, a tertiary aromatic amine, which is particularly useful in the instant invention. Examples of members of the class tertiary aromatic amine include N-3-tolyl-diethanol amine and N-4-tolyldiethanol amine. When the activated resin is employed, application to the catalyst-impregnated fabric causes a very rapid curing to a desirable rigid structure. The monomer or resin is generally used in an amount of from about one-half the weight of fabric to two times the weight of fabric. The amount of tertiary aromatic amine as accelerator in the resin is about 0.1 to about 2.0 phr (parts per hundred of resin).

It has been found that certain properties of the resins can be enhanced by the addition of suitable plasticizer to the system. A plasticizer is a material incorporated in a plastic to increase the workability and flexibility or distensibility of the plastic product. Plasticizers may improve impact resistance of the final product. Organic plasticizers are usually moderately high-molecular-weight liquids or occasionally low-melting solids. Most commonly, organic plasticizers are esters of carboxylic acids. Other types also include hydrocarbons, halogenated hydrocarbons, ethers, polyglycols and sulfonamides. The choice of a specific plasticizer for a given use requires a compromise of desirable properties in each case. It is therefore a preferred embodiment of this invention that the resin system contain a plasticizer to enhance the properties as desired. More preferably, a plasticizer content of from about 10 percent to about 50 percent based on the total resin formulation including the plasticizer. By the term "resin" is meant resin blends comprising two or more thermosetting acrylic monomers; blends comprising at least one thermosetting acrylic monomer and one or more thermosetting polyester resin. The percentage composition of the blended resins include the above-mentioned percentages for acrylic resin and polyester resin.

Catalyst for the production of free radical initiators of polymerization may be used to impregnate the fabric of this invention, but preferred is the organic peroxide type. The catalyst-impregnated fabric should be stable at ambient temperatures. Of the preferred organic peroxide catalysts which are within the class include for example:

2,4-dichlorobenzoyl peroxide
caprylyl peroxide
lauraoyl peroxide
benzoyl peroxide
acetyl peroxide Some mixed peroxides such as acetyl benzoyl peroxides are also suitable.

Prior to the application of the desired catalyst to the fabric, the catalyst may be dissolved in a suitable solvent. For example, benzoyl peroxide in chloroform. Actually, any nonprotonic organic solvent, such as methylene chloride, benzene, cyclohexane and the like, may be employed. The solution of catalyst contains generally the amount from about 1 percent to about 10 percent of catalyst. The solution is applied to the fabric by a suitable means, so as to treat and impregnate the fabric. After application, the catalyst treated fabric is dried to remove the solvent. The fabric then is usable in the dry state. No special handling is required for the peroxide impregnated fabric. Storage should not expose the treated fabric to excessive heat. A variety of techniques may be employed to apply the catalyst, for example, dipping or spraying. The condition to be achieved within the fabric is a thorough intermingling with and in the surrounding area in relation to the threads or fibers of the fabric. It is not indicated that the catalyst is to any extent absorbed by the fibers themselves. It is preferred that for certain uses the fabric have a relatively open, knit structure and the applied resin thereby able to flow in and around the fibers to become rigidly bonded to the fibers and yet retain an open mesh appearance. The catalyst impregnated fabric is furnished in the dry state. The presence of a wet state would be undesirable to the advantages of the instant invention and would incorporate exposure to undesirable solvents.

The fabric material which is impregnated with the preferred organic peroxide-type catalyst described above, may be in the form of a continuous sheet, or of short or long strips. The fabric base can comprise two or more layers folded on each other as in cotton gauze bandages. The material of construction may be of woven or non-woven material, including felt-type materials, as an air-laid felt. The fabric itself is preferably made of cotton, synthetic fiber or fiberglass. However, the particular fabric selected will depend upon the particular application, and accordingly, this invention is not limited to any particular choice of fabric material. The amount of catalyst on the impregnated fabric will depend upon the nature of the fabric. The amount of catalyst present will further depend upon the amount of catalyst retained from the application thereof, i.e., by spraying, dipping, brushing, rolling, or flow techniques.

The activated monomer with the selected accelerator is applied to the dry peroxide catalyst-impregnated fabric. The method of application will vary with the specific use. Contemplated within this invention is the application of the activated vinyl monomer of the polyester or acrylic type described herein by spraying, painting, swabbing and the like. Upon contact with the catalyst-impregnated fabric, the activated resin begins to polymerize almost immediately, such that within a few minutes the composite system is rigid and servicable. The cast or enclosure is light in weight, has an open configuration and conforms to the position and shape of the dry impregnated fabric prior to application of the activated resin. Other layers of fabric can be over laid the initial form almost immediately to obtain a more closed configuration if desired.

Thus, within the skill of those qualified in the orthopedic sciences, the preparation and application of orthopedic casts for use in the treatment of bone fractures or other conditions requiring immobilization of body members may be advantageously formed from the materials and method of this invention. In applying the peroxide catalyst-impregnated fabric from a rolled up material to a body member, the strip of fabric is wrapped around the member in an advancing overlapping manner. When the member has been completely wrapped in the impregnated fabric, an activated vinyl monomer resin described herein is applied, as by spraying, on the fabric. Within one to two minutes, the component system is rigid and usable. The resulting cast thickness will depend upon location of the body portion to be cast; upon the strength and rigidity required.

The examples presented herein serve solely to illustrate the composite system and method of this invention. Accordingly, the examples should not be regarded as limiting the invention in any way. In the examples, the parts and percentages are by weight unless otherwise indicated.

EXAMPLE I

An activated resin was prepared by dissolving 1.0 g. of N-3-tolydiethanol amine in 100.0 g. of ethylene glycol dimethacrylate. This activate resin was sprayed onto a sample of each cotton, nylon and glass cloths which had been dipped into a chloroform solution containing 5 percent benzoyl peroxide. The benzoyl peroxide treated fabric cloths were allowed to dry before application of the activated resin. The resin on the cloth samples began to polymerize and became comfortably warm in 40 seconds. At the end of one minute, the composite system was rigid, hard and servicable.

EXAMPLE II

In a similar method as described in Example I, the following dimethacrylate resins each were used on cotton, nylon and glass cloths. The results in each case are comparable.

a. diethylene glycol dimethacrylate
b. triethylene glycol dimethacrylate
c. hexamethylene glycol dimethacrylate
d. 2,2-bis(2-methacrylatoethoxyphenyl)propane

EXAMPLE III

An activated resin blend was prepared by mixing 100 parts of ethylene glycol dimethacrylate, 100 parts of 2,2-bis(3-methacrylato-2-hydroxypropoxyphenyl)propane and 2 parts of N-3-tolyldiethanol amine. This resin system was sprayed on to benzoyl peroxide catalyzed cloths, prepared in the same manner as Example I. After 20 seconds, the applied resin began to gel and at 30 seconds, the composite system was rigid and servicable. No undesirable heat evolution was detected during gelling of this system.

EXAMPLE IV

In a similar manner as Example III, an activated resin blend was prepared using triethylene glycol dimethacrylate instead of ethylene glycol dimethacrylate. Comparable results were obtained.

EXAMPLE V

An activated vinyl resin blend was prepared by mixing 60 parts triethylene glycol dimethacrylate, 1 part of N-3-tolyldiethanol amine and 40 parts of polyester resin prepared from 2 moles of phthalic anhydride, 1 mole of maleic anhydride and 3 moles of propylene glycol. This resin system was sprayed on to benzoyl peroxide catalyzed cloths, prepared as in Example I. The system gelled in about 2 minutes and became rigid in about 2.5 minutes. No appreciable heat was evolved during the curing of this system. The composite system was rigid and servicable.

EXAMPLE VI

A 4 g. mixture containing 70 percent 2,2-bis(3-methacrylato-2-hydroxypropoxyphenyl)propane and 30 percent of polypropylene glycol (average molecular weight = 400) and 1 percent N-3-tolyldiethanol amine was cured by adding, with mixing 12 drops (about 0.6 g.) of a catalyst solution made from 10 g. triethylene glycol dimethacrylate, 1 g. benzoyl peroxide, and 0.1 g. butylated hydroxytoluene. The system became a hard amber solid in 20 seconds. When a 50—50 percent mixture of resin to polyglycol was used, a milky solid with much poorer physical properties was obtained. Both resin ratios cured when placed upon cloth which had been treated with benzoyl peroxide.

EXAMPLE VII

A resin system was prepared from 70 g. 2,2-bis(3-methacrylato-2-hydroxypropoxyphenyl)propane, 40 g. triethylene glycol dimethacrylate, 30 g. polypropylene glycol (average molecular weight = 400) and 1 g. N-3-tolyldiethanol amine. This system produced a tough amber colored composite solid when applied to cloth which had been treated with benzoyl peroxide.

EXAMPLE VIII

A resin blend was prepared from 25 g. 2,2-bis(3-methacrylato-2-hydroxypropoxyphenol)propane, 25 g. of triethylene glycol dimethacrylate, 25 g. of an isophthalate-maleic acid polyester resin, 25 g. polypropylene glycol (average molecular weight = 400) and 0.7 g. N-3-tolyldiethanol amine. This resin system was applied to glass cloth which had been treated with benzoyl peroxide. The resin began to gel in 20 seconds and was hard in 60 seconds. The composite system was rigid and servicable.

It will readily be appreciated by those skilled in the art that the proportions of the varous components of the system may vary widely depending upon the identity of the components and the conditions under which the system is to be applied and the hardened composite system is to be used. The best proportions in any particular instance can readily be determined on the basis of prior experience and by trial and error. It is also within the scope of the invention to add to the mixture such modifying agents as therapeutic compounds, disinfectants, deodorants and coloring agents, e.g., dyes and pigments. Proportions of such optional components as therapeutic compounds, deodorants, disinfectants, coloring materials, inactive fillers, and the like, are largely a matter of choice, it being understood of course that they should be present only in minor amounts sufficient to accomplish their intended functions and not in quantities large enough to interfere with the primary objectives of the system.

What is claimed is:

1. A method for preparing a rigid enclosure comprising the steps:

a. wrapping the object to be enclosed with a free radical organic peroxide catalyst impregnated fabric;

b. applying to said fabric an activated thermosetting vinyl resin activated with a tertiary aromatic amine;

c. allowing said fabric to harden about said object.

2. The method of claim 1 in which said resin is selected from the group consisting of ethylene glycol dimethacrylate, diethylene glycol dimethacrylate, triethylene glycol dimethacrylate, hexamethylene glycol dimethacrylate, 2,2-bis(2-methacrylatoethoxyphenyl)-propane, a blend of ethylene glycol dimethacrylate and 2,2-bis(3-methacrylato-2-hydroxypropoxyphenyl) propane, a blend of triethylene glycol dimethyacrylate and 2,2-bis(3-methacrylato-2-hydroxypropoxyphenyl)propane, and a blend of triethylene glycol dimethacrylate and a polyester resin comprising phthalic anhydride, maleic anhydride and propylene glycol.

3. The method of claim 2 in which the fabric is impregnated with benzoyl peroxide and the resin is ethylene glycol dimethacrylate activated with N-3-tolyldiethanol amine.

4. The method of claim 2 in which the fabric is impregnated with benzoyl peroxide and the resin is diethylene glycol dimethacrylate activated with N-3-tolyldiethanol amine.

5. The method of claim 2 in which the fabric is impregnated with benzoyl peroxide and the resin is triethylene glycol dimethacrylate activated with N-3-tolyldiethanol amine.

6. The method of claim 2 in which the fabric is impregnated with benzoyl peroxide and the resin is hexamethylene glycol dimethacrylate activated with N-3-tolyldiethanol amine.

7. The method of claim 2 in which the fabric is impregnated with benzoyl peroxide and the resin is 2,2-bis(2-methacrylatoethoxyphenyl)propane activated with N-3-tolyldiethanol amine.

8. The method of claim 2 in which the fabric is impregnated with benzoyl peroxide and the resin is a blend of ethylene glycol dimethacrylate and 2,2-bis(3-methacrylato-2-hydroxypropoxyphenyl)propane activated with N-3-tolyldiethanol amine.

9. The method of claim 2 in which the fabric is impregnated with benzoyl peroxide and the resin is a blend of triethylene glycol dimethacrylate and 2,2-bis(3-methacrylato-2-hydroxypropoxyphenyl)propane activated with N-3-tolyldiethanol amine.

10. The method of claim 2 in which the fabric is impregnated with benzoyl peroxide and the resin is a blend of triethylene glycol dimethacrylate, activated with N-3-tolyldiethanol amine and a polyester resin comprising phthalic anhydride, maleic anhydride and propylene glycol.

11. A method for the application of an orthopedic body cast to a body member which comprises the steps:

a. wrapping said body member in a free radical organic peroxide catalyst impregnated fabric;

b. applying to said fabric an activated thermosetting vinyl resin activated with about 0.1 to about 2.0 parts per hundred of resin of a tertiary aromatic amine;

c. allowing said fabric to harden about said body member.

12. The method of claim 11 in which the free radical organic peroxide catalyst is benzoyl peroxide, the vinyl resin is ethylene glycol dimethacrylate and the tertiary aromatic amine is N-3-tolyldiethanol amine.

13. The method of claim 11 in which the free radical organic peroxide catalyst is benzoyl peroxide, the vinyl resin is a blend of ethylene glycol dimethacrylate and 2,2-bis(3-methacrylato-2-hydroxypropoxyphenyl)propane and the tertiary aromatic amine is N-3-tolyldiethanol amine.

14. The method of claim 11 in which the free radical organic peroxide catalyst is benzoyl peroxide, the vinyl resin is a blend of triethylene glycol dimethacrylate, activated with N-3-tolyldiethanol amine and a polyester resin consisting of phthalic anhydride, maleic anhydride and propylene glycol.

15. A method for preparing a rigid enclosure comprising the steps:

a. wrapping the object to be enclosed with a free radical organic peroxide catalyst-impregnated fabric;

b. applying to said fabric an activated thermosetting vinyl resin containing from about 10 percent to about 50 percent plasticizer and activated with a tertiary aromatic amine.

16. The method according to claim 15 wherein said activated thermosetting vinyl resin is a blend of up to about 90 percent acrylic resin, from about 5 percent to about 35 percent polyester resin and from about 10 percent to about 50 percent plasticizer.

17. The method according to claim 15 in which the tertiary aromatic amine is N-3-tolyldiethanol amine.

* * * * *